US006004212A

United States Patent [19]

Smirnov

[11] Patent Number: 6,004,212

[45] Date of Patent: Dec. 21, 1999

[54] SPORTS DEVICE FOR IMITATING WEAPON FIGHT

[76] Inventor: Nikolai Smirnov, 35 E. Madison Ave., Clifton, N.J. 07011

[21] Appl. No.: 09/084,325

[22] Filed: May 26, 1998

[51] Int. Cl.[6] ..... F41B 15/02

[52] U.S. Cl. ..... 463/47.2; 463/47.6

[58] Field of Search ..... 463/47.2, 47.4, 463/47.6; 473/565

[56] References Cited

U.S. PATENT DOCUMENTS

| | | | |
|---|---|---|---|
| 2,026,077 | 12/1935 | True | 463/47.2 |
| 3,518,024 | 6/1970 | Wilson | 473/565 |
| 5,085,433 | 2/1992 | Parsons | 463/47.6 |
| 5,330,181 | 7/1994 | Wong | 463/47.4 |

*Primary Examiner*—William M. Pierce

*Attorney, Agent, or Firm*—Ilya Zborovsky

[57] ABSTRACT

A sport device imitating weapon fight has two elongated elements which are connected with one another to form a substantially right angle therebetween, one of the elongated elements being formed to be held by a user, the other of the elongated elements being longer than the one elongated element and has two longitudinal edges and two transverse edges, the other elongated element being substantially flat, one of such longitudinal edges of the other elongated element having a thickness which is smaller than a thickness of a remaining part of the other elongated element to increase efficiency of a strike transversely to the other longitudinal element by the at least one longitudinal edge, one of the transverse edges of the other elongated element being provided with a substantially sharp formation to improve efficiency of a strike delivered along the other elongated element.

8 Claims, 1 Drawing Sheet

SPORTS DEVICE FOR IMITATING WEAPON FIGHT

BACKGROUND OF THE INVENTION

The present invention relates to sports devices which imitate fights with the use of weapon, as well as to devices which can be used for self defense.

Devices of the above mentioned general type are known in the art. One of such devices is for example formed as an elongated round bar which is held by its one end and can delivery corresponding strikes. Such a device is used in sports, in self defense, as well as for example by police. It is believed that the known device can be further improved.

SUMMARY OF THE INVENTION

Accordingly, it is an object of present invention to provide a sport device for imitating weapon fight which is a further improvement of the existing devices.

In keeping with these objects and with others which will become apparent hereinafter, one feature of present invention resides, briefly stated in a sport device imitating weapon fight, comprising two elongated elements which are connected with one another to form a substantially right angle therebetween, one of said elongated elements being formed to be held by a user, the other of said elongated elements being longer than the one elongated element and has two longitudinal edges and two transverse edges, said other elongated element being substantially flat, one of such longitudinal edges of said other elongated element having a thickness which is smaller than a thickness of a remaining part of said other elongated element to increase efficiency of a strike transversely to said other elongated element by said at least one longitudinal edge, one of said transverse edges of said other elongated element being provided with a substantially sharp formation to improve efficiency of a strike delivered along said other elongated element.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 2:
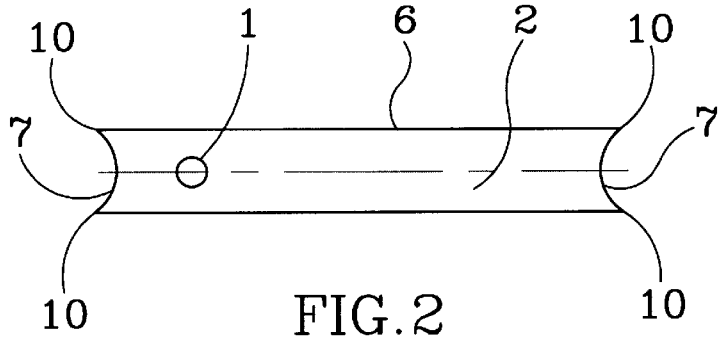
FIG. 2 is a plan view of the inventive device.
Figure 1:
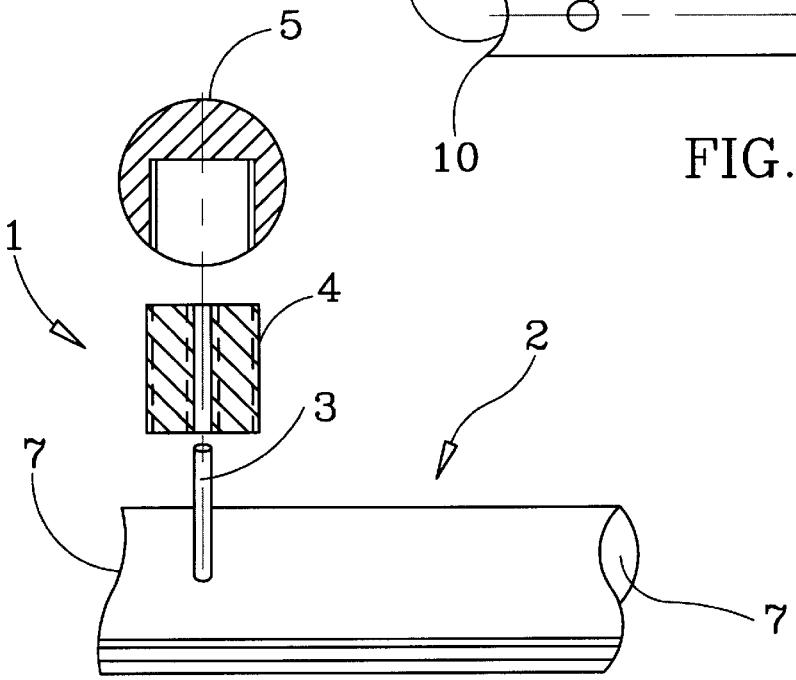
FIG. 1 is a side view of a sports device for imitation weapon fight in accordance with the present invention.

A sports device for imitation weapon fight includes two elongated elements. One of said elongated elements is identified with reference numeral 1 while the other of said elongated elements is identified with reference numeral 2 as a whole.

The first elongated element 1 includes a rod 3 with a substantially sleeve shape member 4 which is fitted on the rod 3, and a substantially spherical member 5 which is fitted on the sleeve shaped member 4. The sleeve shape member

4 can be screwed on the rod 3 by interegagement of the corresponding outer thread of the rod 3 and the inner thread of the sleeve shaped member 4. The substantially spherical member 5 can be screwed on the upper portion of the sleeve-shaped member 4 also by cooperation of corresponding threads. The thusly assembled first elongated element 1 forms a handle of the inventive sports device.

The elongated elements 1 and 2 are connected with one another so as to form a substantially right angle therebetween. The connection can be performed by forcedly fitting of the rod 3 into a corresponding opening in the elongated member 2, by welding the elongated members 1 and 2 with one another, or by any other known methods.

The elongated element 2 has two longitudinal edges 6 and two transverse edges 7. Each longitudinal edge 6 has a thickness T1 which is substantially smaller than the total thickness T2 of the remaining part of the elongated member 2. As a result, each elongated edge 6 substantially enhances a striking force applied by a user when it strikes an object or an attacker with at least one of the longitudinal edges 6. It is to be understood that either one longitudinal edge 6, or both longitudinal edges 6 can be formed in the above described manner.

Figure 3:
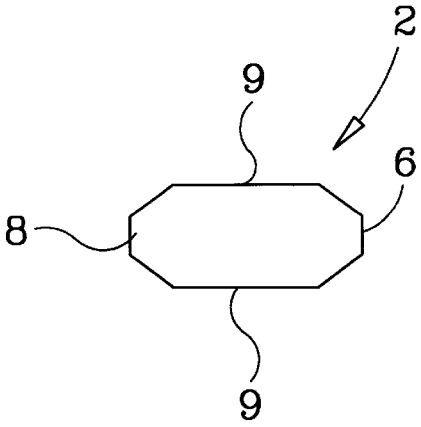
FIG. 3 is a cross-section of a longer elongated member of the device in accordance with the present invention.

In a preferable embodiment of the invention, in order to provide the longitudinal edges 6, the elongated element 2 has a cross-section including a central rectangular part 8 and two and trapezoidal parts 9 arranged so that a longer base of each trapezoidal part 9 coincides with a longer side of the rectangle 8. The trapezoidal parts 9 can have equal inclined sides. The above described cross-section is shown in detail in FIG. 3.

The transverse sides of the transverse edges of the elongated member 2 are provided with at least one substantially sharp formation identified with reference numeral 10. In the embodiment shown in FIG. 2, each transverse edge 7 of the elongated member 2 has two such formations. In accordance with a preferable embodiment of the invention, each transverse edge is arcuate and convex. Therefore, the sharp formations 10 are formed in the area of connection of each transverse edge 7 with each longitudinal edge 6 of the elongated member 2.

The device operates in the following manner:

A user holds the device by grasping the first elongated member one or more particularly the handle formed by a combination of the parts 3, 4, 5, and moves the device so as to deliver a strike either by one longitudinal edge of the device or by at least one of the transverse edge of the device.

Figure 4:
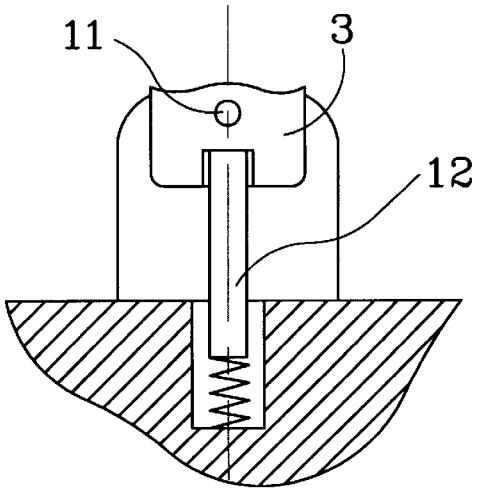
FIG. 4 shows a further embodiment of the invention.

As shown in FIG. 4 the rod 3 can be turnable about an axis to a horizontal folded position. In the vertical position it is fixed by a spring biased catch 12. The catch 12 project transversely beyond the rod 3 and can be depressed by a user for turning to the horizontal position.

When the device is designed in accordance with the present invention it is highly effective for imitation of weapon fight, for self defense, etc.

It will be understood that each of the elements described above, or two or more together, may also find a useful application in other types of constructions differing from the types described above.

While the invention has been illustrated and described as embodied in sports device for imitating weapon fight, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sports device imitating weapon fight, comprising two elongated elements which are connected with one another to form a substantially right angle therebetween, one of said elongated elements being formed to be held by a user, the other of said elongated elements being longer than the one elongated element and has two longitudinal edges and two transverse edges, said other elongated element being substantially flat, one of such longitudinal edges of said other elongated element having a thickness which is smaller than a thickness of a remaining part of said other elongated element to increase efficiency of a strike transversely to said other longitudinal element by said at least one longitudinal edge, one of said transverse edges of said other elongated element being provided with a substantially sharp formation to improve efficiency of a strike delivered along said other elongated element, said other elongated element having a cross-section which is formed by a central rectangle and two trapezes located at opposite sides of said rectangle and having a longer base abutting against a corresponding longer side of said rectangle, a smaller side of said rectangle forming said one longitudinal edge of said other elongated element.

2. A sport devices as defined in claim 1, wherein said one longitudinal edge of said other elongated element is substantially flat.

3. A sports device as defined in claim 1, wherein said other elongated element has another longitudinal edge which is formed substantially identically to said one longitudinal edge.

4. A sports device as defined in claim 1, wherein the other of said transverse sides of said other elongated element is substantially identical to said at least one transverse side.

5. A sports device as defined in claim 1; and further comprising means forming a handle on said one elongated element.

6. A sports device as defined in claim 5, wherein said means include a substantially sleeve-shaped element fitted on said one elongated element.

7. A sports device as defined in claim 1, wherein said one elongated element is turnable to an inoperative position to extend along said other element.

8. A sports device imitating weapon fight, comprising two elongated elements which are connected with one another to form a substantially right angle therebetween, one of said elongated elements being formed to be held by a user, the other of said elongated elements being longer than the one elongated element and has two longitudinal edges and two transverse edges, said other elongated element being substantially flat, one of such longitudinal edges of said other elongated element having a thickness which is smaller than a thickness of a remaining part of said other elongated element to increase efficiency of a strike transversely to said other longitudinal element by said at least one longitudinal edge, one of said transverse edges of said other elongated element being provided with a substantially sharp formation to improve efficiency of a strike delivered along said other elongated element, said at least one transverse edge of said other elongated element being arcuate and convex so that two such formations are provided in a region of merging of said at least one convex transverse side of said other elongated element and each of said longitudinal sides of said other elongated element.

* * * * *